United States Patent [19]

Kaminaga

[11] Patent Number: 4,561,228

[45] Date of Patent: Dec. 31, 1985

[54] UNIT CURTAIN WALL

[75] Inventor: Hiromitsu Kaminaga, Kurobe, Japan

[73] Assignee: Yoshida Kogyo K.K., Tokyo, Japan

[21] Appl. No.: 611,898

[22] Filed: May 18, 1984

[30] Foreign Application Priority Data

May 20, 1983 [JP] Japan ..... 58-74675

[51] Int. Cl.[4] ..... E04B 2/88

[52] U.S. Cl. ..... 52/235; 52/403; 52/509

[58] Field of Search ..... 52/235, 303–403, 52/506–512, 302, 303, 304, 478, 486, 489, 378; 285/191

[56] References Cited

U.S. PATENT DOCUMENTS

| | | | |
|---|---|---|---|
| 3,052,330 | 9/1962 | Hammitt et al. | 52/403 X |
| 3,466,826 | 9/1969 | Gallagher et al. | 52/235 X |
| 3,553,918 | 1/1971 | Dauson | 52/235 X |
| 3,936,986 | 2/1976 | Steel | 52/235 |
| 3,940,897 | 3/1976 | Stoakes | 52/397 X |
| 3,956,863 | 5/1976 | Tiedeken | 52/399 |
| 4,458,745 | 7/1984 | Gartner | 285/191 X |
| 4,483,122 | 11/1984 | Crandell | 52/235 X |

FOREIGN PATENT DOCUMENTS

| | | | |
|---|---|---|---|
| 8272 | 2/1980 | European Pat. Off. | 52/235 |
| 2006641 | 8/1971 | Fed. Rep. of Germany | 52/235 |
| 2305394 | 8/1974 | Fed. Rep. of Germany | 52/235 |
| 2364224 | 11/1975 | Fed. Rep. of Germany | 52/235 |
| 2428754 | 12/1975 | Fed. Rep. of Germany | 52/235 |
| 1293557 | 4/1962 | France | 52/235 |

*Primary Examiner*—Donald G. Kelly
*Assistant Examiner*—Richard E. Chilcot, Jr.

[57] ABSTRACT

A unit curtain wall includes a plurality of curtain wall units each supported on a building skeleton frame by means of a pair of fasteners connected respectively to a pair of horizontally spaced vertical edges of the curtain wall unit. One of vertically adjacent horizontal edges of each pair of adjacent curtain wall units has a pin receivable in a hole in the other horizontal edge to hold the two vertically adjacent curtain wall units in vertical alignment. A sealing strip is disposed on the exterior side of the pin and extends along the one horizontal edge and sealingly receivable in a groove in the other horizontal edge to provide a fluid-tight sealing between the two vertically adjacent curtain wall units.

9 Claims, 5 Drawing Figures

UNIT CURTAIN WALL

BACKGROUND OF THE INVENTION

1. Field of the Invention

The present invention relates to a unit curtain wall composed of a plurality of curtain wall units arranged in checkerboard pattern, and more particularly a joint structure for an adjacent pair of vertically opposed curtain wall units of such unit curtain wall.

2. Prior Art

In a prior unit curtain wall, each curtain wall unit is connected at its vertically spaced horizontal edges to a pair of horizontal building skeleton frame members. The curtain wall unit thus connected tends to become inwardly curved in its middle between the building skeleton frame members when wind pressure acts on the unit curtain wall. Such drawback has been substantially eliminated in another prior unit curtain wall in which each curtain wall unit is hung on a single building skeleton frame member by means of a pair of fasteners mounted on the building skeleton frame member and connected respectively to horizontally spaced vertical edges of the curtain wall unit at respective intermediate portions thereof. This unit curtain wall construction has however another disadvantage. Since the opposite horizontal edges of the curtain wall unit are unstable in position and hence tend to be displaced in a direction normal to the unit curtain wall, fluid-tight sealing between an adjacent pair of vertically opposed curtain wall units is difficult to achieve, and assembling the two vertically adjacent curtain wall units becomes tedious and time consuming.

SUMMARY OF THE INVENTION

It is accordingly an object of the present invention to provide a unit curtain wall in which curtain wall units are rigid against bending when subjected to wind pressure, have respective opposite horizontal edges held stably in position, have a fluid-tight sealing between each pair of vertically adjacent curtain wall units, and are easy to join together.

According to the present invention, a unit curtain wall includes a plurality of curtain wall units each supported on a building skeleton frame by means of a pair of fasteners connected respectively to a pair of horizontally spaced vertical edges of the curtain wall unit. An auxiliary support secured to the building skeleton frame is connected to a lower one of vertically adjacent horizontal edges of each pair of adjacent curtain wall units for preventing the lower edge from being displaced normal to the unit curtain wall. One of the horizontal edges has a pin receivable in a hole in the other horizontal edge to hold the two vertically adjacent curtain wall units in vertical alignment. A sealing strip is disposed on the exterior side of the pin and extends along the one horizontal edge and sealingly receivable in a groove in the other horizontal edge to provide a fluig-tight sealing between the two vertically adjacent curtain wall units.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Throughout the specification, the terms "inner", "outer", "inwardly", and "outwardly" are used with reference to the geometric center of a building to which a unit curtain wall is to be attached.

Figure 1:
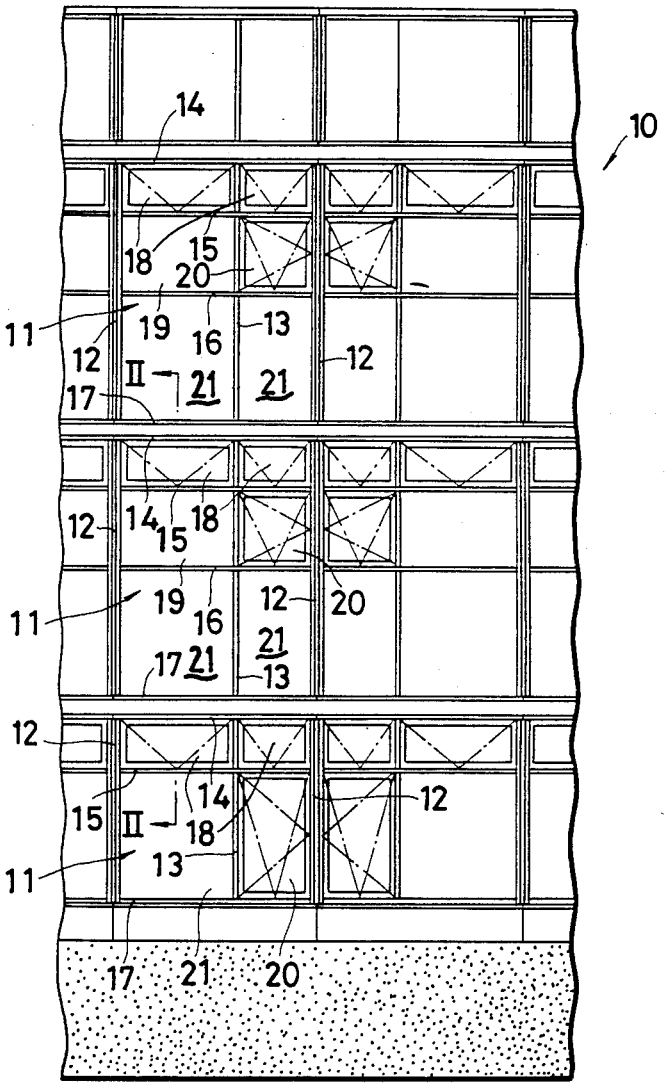
FIG. 1 is a fragmentary front elevational view of a unit curtain wall according to the present invention.
Figure 2:
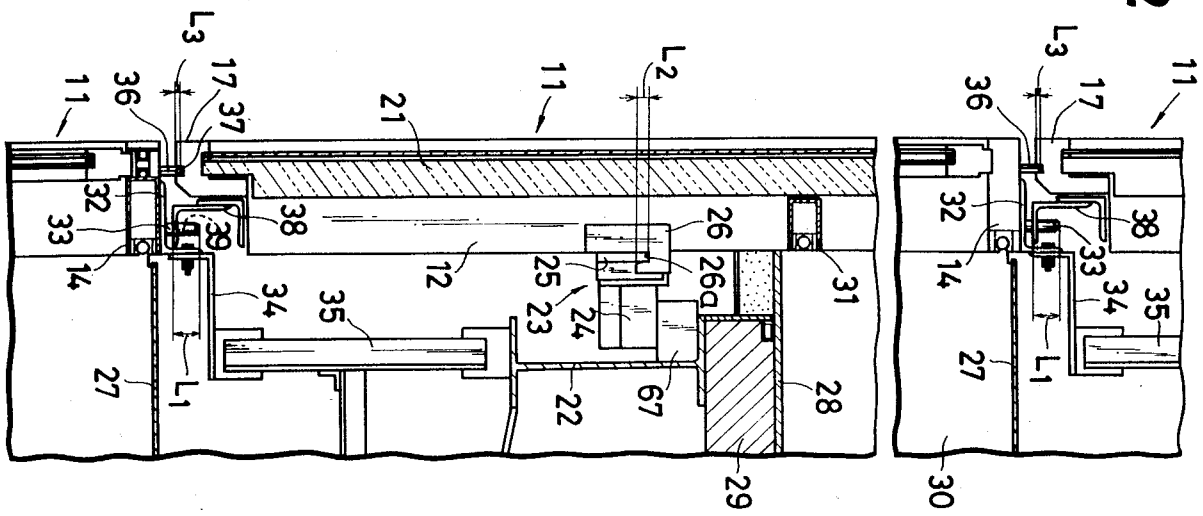
FIG. 2 is an enlarged fragmentary vertical cross-sectional view taken along line II—II of FIG. 1.

As shown in FIG. 1, a unit curtain wall 10 is composed of a plurality of curtain wall units 11 arranged in a checkerboard pattern to cover an exterior side of a building. Each of the curtain wall units 11 comprises a pair of vertical frame members 12, 12, a mullion 13, an upper horizontal frame member 14, a transom 15, an intermediate transom 16, and a lower horizontal frame member 17. These frame members 12–17 are interconnected to provide six rectangular frames of different sizes in which two lights 18, a fixed double-glazed panel 19, a pivotable double-glazed panel 20, and two glass-and-thermal insulator composite panels 21 are mounted. The curtain wall units 11 are connected to and hung on building skeleton frame members 22 by a plurality of fasteners 23, only one of each of the members 22 and fasteners 23 being shown in FIG. 2. The building skeleton frame member 22 is a steel I-beam. The fastener 23 includes a first fastener member 24 mounted on the I-beam 22, and a second fastener member 25 mounted on the first fastener member 24 and interlockingly engageable with a hook-shaped bracket 26 secured to each of the vertical frame members 12 at an intermediate portion thereof.

A ceiling panel 27 is supported at its outer edge on the upper horizontal frame member 14. A floor panel 28 is supported on the upper flange of the I-beam 22 with a suitable flooring material 29 interposed therebetween, there being defined a room 30 between the panels 27, 28. A transverse frame member 31 extends between the vertical frame members 12 below the intermediate transom 16 (FIG. 1) and is connected to the vertical frame members 12, the composite panel 21 being disposed against an exterior surface of the transverse frame member 31. Each pair of vertically adjacent curtain wall units 11, 11 has a pair of opposed ones of the upper and lower horizontal frame members 14, 17. Each curtain wall unit 11 has a height corresponding to the height of one building floor. The vertical frame members 12 of each curtain wall unit 11 are respectively supported at the intermediate portions thereof by means of two of the fasteners 23 mounted on the building skeleton frame member 22, the curtain wall unit 11 hung on the building skeleton frame member 22 being substantially prevented from being inwardly curved in its middle when subjected to wind pressure.

An L-shaped bracket 32 is attached to the upper horizontal frame member 14 on the interior side of the latter and has a positioning projection such, for example, as a pin 33 projecting toward the lower horizontal frame member 17 of an adjacent one of the curtain wall units 11. The bracket 32 is connected by a fastener 34 to one end of an auxiliary support bar 35 which is connected at the other end thereof to the lower flange of the I-beam 22. With this construction, the unit curtain wall 11 is prevented from being displaced at its upper end in a direction perpendicular to the plane of the unit curtain wall 10. A sealing strip 36 is disposed on the upper horizontal frame member 14 on the exterior side thereof and extends longitudinally throughout the length of the upper horizontal frame member 14. The sealing strip 36 projects into a longitudinal groove 37 in the lower horizontal frame member 17 of the adjacent curtain wall unit 11. The lower horizontal frame member 17 has attached thereto an L-shaped bracket 38 having a hole 39 for receiving therein the positioning pin 33 on the upper horizontal frame member 14.

A length L1 of engagement between the pin 33 and the bracket 38 (a length of the portion of the pin 33 which projects into and through the opening 39) is greater than a length L2 of engagement between the hook-shaped bracket 26 and the second fastener member 25 (the depth of a recess 26*a* in the hook-shaped bracket 26). The length L2 is greater than a length of engagement between the sealing strip 36 and the longitudinal groove 37 (a length of the portion of the strip which is received in the groove 37). With the lengths L1, L2, L3 thus adjusted, when one curtain wall unit 11 is mounted on the previously installed unit curtain wall unit 11 from the above, engagement occurs first between the pin 33 and the hole 39, then between the hook-shaped bracket 36 and the second fastener member 25, and finally between the sealing strip 36 and the groove 37.

Figure 3:
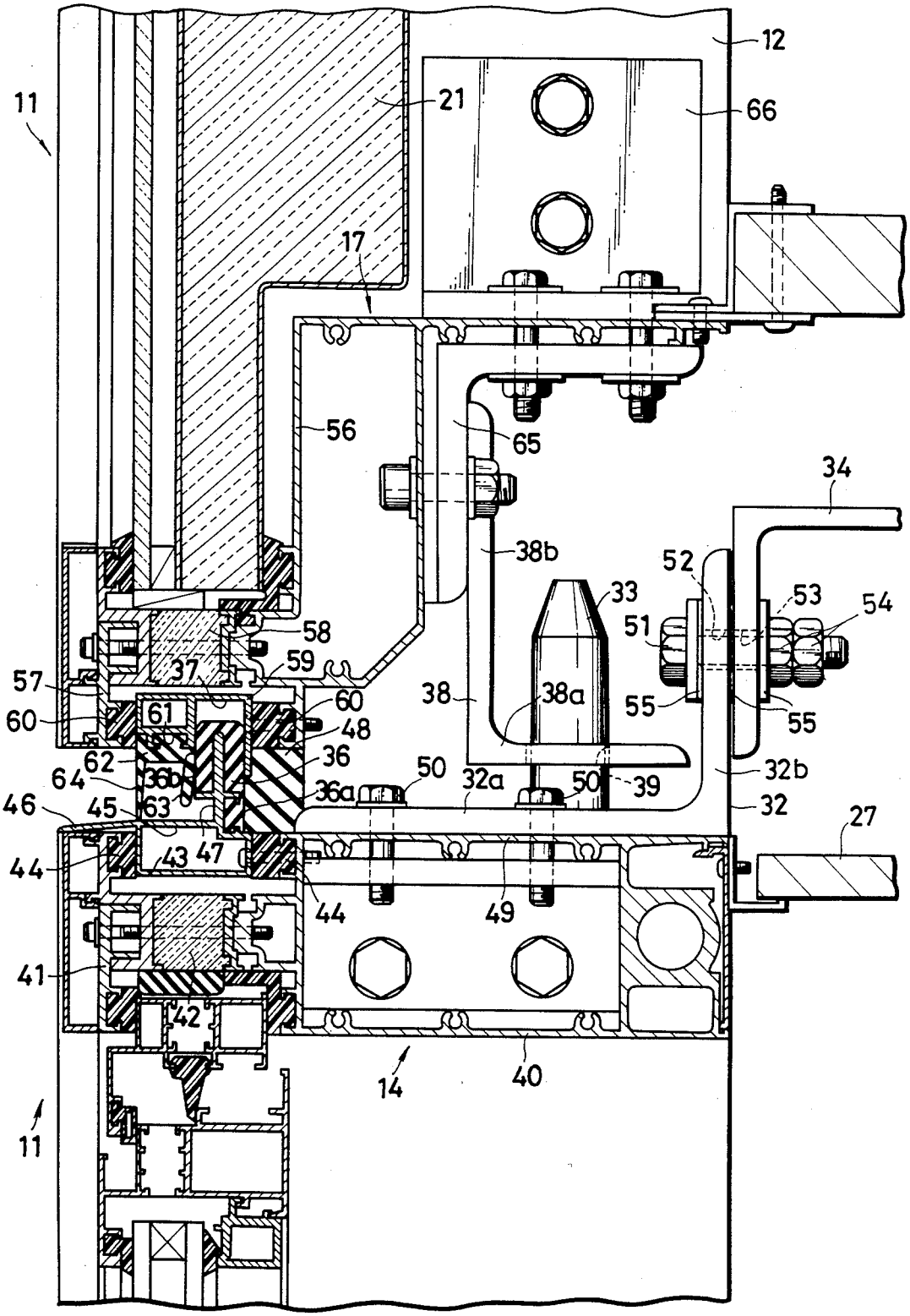
FIG. 3 is an enlarged cross-sectional view of a portion of the unit curtain wall, the view showing a joint structure of an adjacent pair of vertically opposed curtain wall units.

As shown in FIG. 3, the upper horizontal frame member 14 has an interior part or frame body 40 and an exterior part or holder bar 41 fixed to the frame body 40 by means of screws (one being shown) with a thermally insulating connector 42 placed between the frame body 40 and the holder bar 41. A top covering bar 43 extends longitudinally between the frame body 40 and the holder bar 41 over the connector 42. The bar 43 is secured to the frame body 40 by screws (one being shown) with a pair of sealing strips 44, 44 interposed respectively between the frame body and the top covering bar 43, and the top covering bar 43 and the holder bar 41. The top covering bar 43 has a hollow rectangular body including an upper wall 45, a flashing 46 extending from an exterior edge of the upper wall 45 and a sloping outwardly downwardly, and a vertical fin 47 disposed on the upper wall 45 adjacent to an interior edge thereof and extending throughout the length of the covering bar 43. The vertical fin 47 supports thereon the sealing strip 36. An interior sealing member 48 is disposed on the top horizontal frame member 14 along the length thereof and is bonded to an exterior side surface 36*a* of the sealing strip 36, the sealing strip 36 and the interior sealing member 48 being made of soft rubber.

The frame body 40 has a substantially hollow rectangular cross section and includes an upper wall 49 to which a horizontal arm 32*a* of the bracket 32 is secured by means of screws 50 (two being shown). A vertical arm 32*b* of the bracket 32 is secured to the fastener 34 by means of a bolt 51 extending through an oblong hole 52 in the vertical arm 32*b* and through a hole 53 in the fastener 34, and a pair of nuts 54 threaded on the bolt 51. The oblong hole 53 extends longitudinally of the frame body 40, and a pair of ring washers 55 of low frictional resistance material is carried on the bolt 51, one on each side of the vertical arm 32*b*. The ring washers 55 are made of polyfluoroethylene film. With this arrangement, the bracket 32 and hence the curtain wall unit 11 is allowed to move smoothly in a direction horizontally parallel to the curtain wall units 11. The oblong hole 53 can be used to receive the hook of a crane or lifting machine (not shown) when the unit curtain wall 11 is being installed.

The lower horizontal frame member 17 includes an interior part or frame body 56 and an exterior part or holder bar 57 fixed to the frame body 56 by screws (one being shown) with a thermally insulating connector 58 interposed between the frame body 56 and the holder bar 57. A bottom covering bar 59 extends longitudinally between the frame body 56 and the holder bar 57 beneath the connector 58. The bar 59 is secured to the frame body 56 by screws (one being shown) with a pair of sealing strips 60, 60 interposed respectively between the frame body 56 and the bottom covering bar 59, and the bottom covering bar 59 and the holder bar 57. The groove 37 is formed in the bottom covering bar 59, and a downwardly opening recess 61 extends longitudinally in the bottom covering bar 59 along the groove 37 on the exterior side thereof. An exterior sealing member 62 is fitted in the longitudinal recess 61 and has along the length thereof a pair of laterally spaced interior and exterior tongue 63, 64. The exterior tongues 64 depends parallel to the plane of the curtain wall unit 11 and the interior tongue 63 tilts slightly toward the exterior tongue 64, the exterior tongue 64 being longer than the interior tongue 63. The exterior sealing member 62 is made of soft rubber.

The L-shaped bracket 38 has a horizontal arm 38*a* in which the hole 39 is formed, and a vertical arm 38*b* joined with the frame body 56. The hole 39 has an oblong shape extending longitudinally of the frame body 56, a pair of opposed major edges of the oblong hole 39 serving as positioning edges when the pin 33 is received therein. A pair of L-shaped brackets 65, 66 is bolted to the frame body 56 and the vertical frame member 12, respectively. The brackets 65, 66 have their respective horizontal arms fastened together with a portion of the frame body 56 sandwiched therebetween, thereby connecting the lower horizontal frame member 17 to the vertical frame member 12. When the vertically opposed curtain wall units 11, 11 are held in the assembled position illustrated in FIG. 3, the sealing strip 36 is partly received in the groove 37; the interior sealing member 48 is compressed between the upper and lower horizontal frame members 14, 17; the interior tongue 63 of the exterior sealing member 62 sealingly engages the exterior side surface 36*b* of the sealing strip 36; and the exterior tongue 64 of the sealing member 62 abuts against the flashing 46 of the top covering bar 43. This arrangement provides a fluid-tight sealing between the curtain wall units 11, 11. Since the sealing strip 36 is partly received in the groove 37, and since the interior and exterior sealing members, 48, 62 are made of soft rubber, vertical displacement between the vertically opposed curtain units 11, 11 can be taken out or absorbed.

Figure 4:
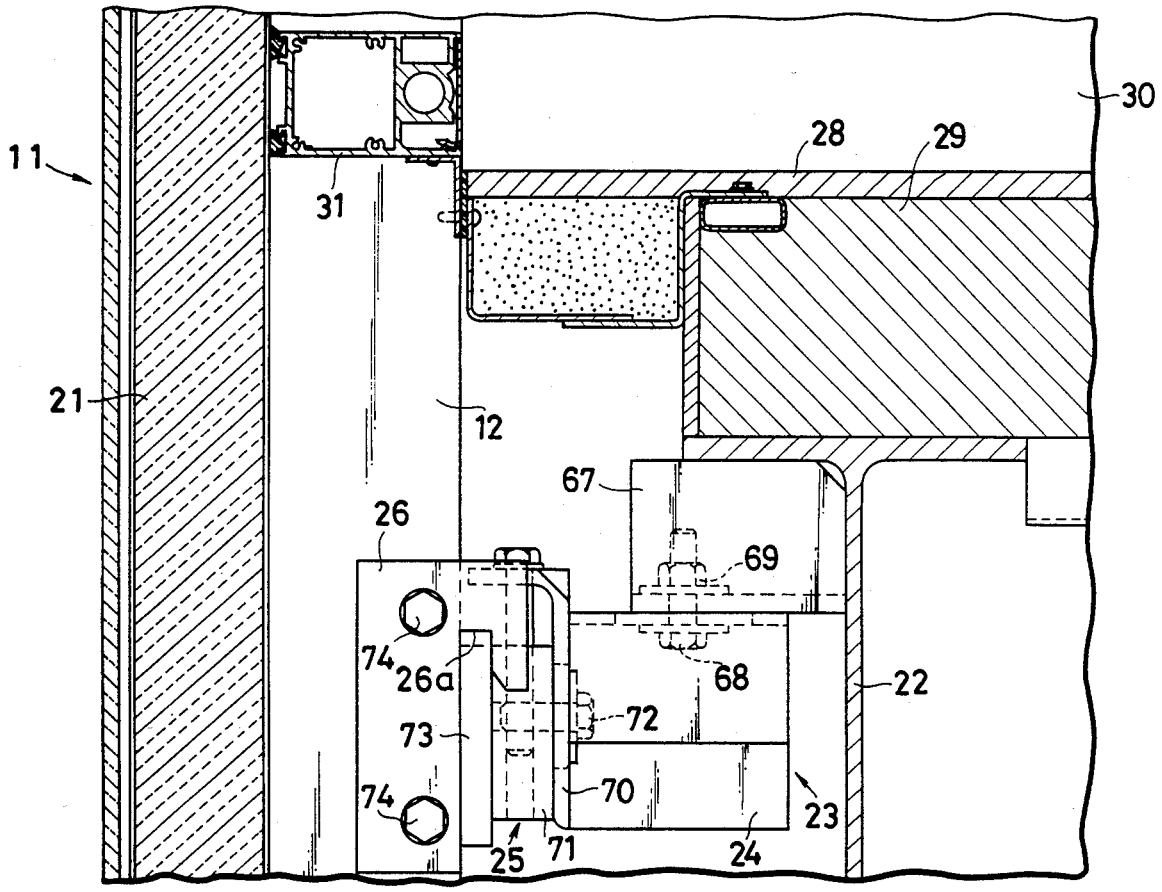
FIG. 4 is an enlarged cross-sectional view of another portion of the unit curtain wall having a fastener.

As shown in FIG. 4, a mounting base 67 is welded to the underside of the upper flange of the I-beam 22. The first fastener member 24 is adjustably connected to the mounting base 67 by bolts 68 and nuts 69 (one pair being shown). The first fastener member 24 includes an inverted L-shaped end plate 70 welded to an exterior end of the fastener member 24. The second fastener member 25 includes a block 71 adjustably connected to a vertical arm of the end plate 70 by means of screws 72 (one being shown), and a support plate 73 fixedly secured to the block 71 and facing toward the vertical frame member 12. The hook-shaped bracket 26 is attached to an outer side surface of the vertical frame member 12 by means of a pair of screws 74.

Figure 5:
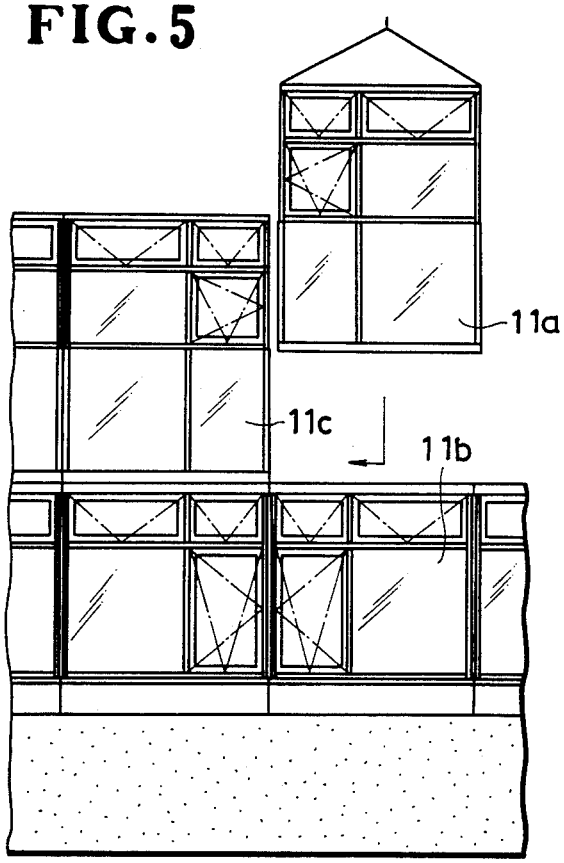
FIG. 5 is a fragmentary front elevational view of the unit curtain wall, illustrating the manner in which an adjacent pair of vertically opposed curtain wall units is joined.

For installation, as shown in FIG. 5, a curtain wall unit 11*a* is lifted by the crane (not shown) and positioned in vertical alignment with a previously installed lower curtain wall unit 11*b*, the curtain wall units 11*a*, 11*b* having the same construction as the curtain wall units 11, 11. Then, the curtain wall unit 11*a* is lowered toward the lower curtain wall unit 11*b*. With continued downward movement of the curtain wall unit 11*a*, the positioning pin 33 on the bracket 32 is received in the hole 39 in the bracket 38 to thereby position the lower horizontal frame member 17 of the curtain wall unit 11*a* with respect to the upper horizontal frame member 14 of the lower curtain wall unit 11*b*. Since the upper horizontal frame member 14 is secured to the building skeleton frame member 22 by means of the auxiliary support bar 25 and the fastener 34, smooth insertion of the pin 33 into the hole 39 can be achieved with utmost ease. Further lowering of the curtain wall unit 11*a* causes the hook-shaped brackets 26 to engage the support plates 73 of the second fastener members 25. The curtain wall unit 11*a* is moved horizontally toward a previously installed left curtain wall unit 11*c* (having the same construction as the curtain wall units 11), and is then joined to the latter while the supports plates 73 are being partly received in the respective grooves 26*a* in the brackets 26. The curtain wall unit 11*a* is further moved downwardly to the piston of FIG. 3, during which time the sealing strip 36 is fitted in the groove 37.

The unit curtain wall 10 thus constructed has various advantages: With the vertical frame members 12 supported on the building skeleton frame member 22 at intermediate portions thereof by means of the fasteners 23, the curtain wall unit 11 is structurally rigid against bending when subjected to wind pressure. As the auxiliary support bar 35 and the fastener 34 jointly hold the upper portion of the unit curtain wall 11 stably in position against displacement in a direction perpendicular to the plane of the unit curtain wall 10, an adjacent pair of vertically opposed upper and lower curtain wall units 11, 11 can be joined with utmost ease. Interlocking engagement between the pin 33 and the hole 39 prevents the upper curtain wall unit 11 from being displaced in the direction perpendicular to the unit curtain wall 10 during installation. The sealing strip 36, the groove 37 receiving the sealing strip 36, and the interior and exterior sealing members 48, 62 jointly provide a fluid-tight sealing between the upper and lower curtain wall units 11. Since the curtain wall unit 11 is connected at its upper edge to the building skeleton frame 22 and at its lower edge to the previously installed curtain wall unit 11, the unit curtain wall 10 can be built up with the curtain wall units 11 joined together in row in a either horizontal or vertical direction.

Although various minor modifications may be suggested by those versed in the art, it should be understood that I wish to embody within the scope of the patent warranted heron, all such embodiments as reasonably and properly come within the scope of my contribution to the art.

What is claimed is:

1. A unit curtain wall comprising:

(a) a plurality of adjacent curtain wall units each having a pair of horizontally spaced vertical edges, said adjacent pair of curtain wall units having respectively a pair of vertically adjacent horizontal frame members each including a pair of interior and exterior parts connected together;

(b) a pair of fasteners adapted to be mounted on a building frame and connected respectively to said vertical edges of a respective one of said curtain wall units for supporting the latter on said building frame;

(c) an auxiliary support adapted to be mounted on the building frame and connected to a lower one of vertically adjacent horizontal edges of each pair of adjacent curtain wall units;

(d) a projection disposed on one of said vertically adjacent horizontal edges on said interior part of one of said horizontal frame members, the other horizontal edge having a portion defining a pair of positioning edges on said interior part of the other horizontal frame member extending substantially longitudinally of said horizontal edges and receptive of said projection; and (e) an elastic sealing strip disposed on and along one of said horizontal edges, on the exterior side of said projection, the other horizontal edge having a groove receptive of said sealing strip.

2. A unit curtain wall according to claim 1, including an L-shaped bracket having a vertical arm connected to said interior part of said other horizontal frame member and a horizontal arm, said positioning edges being defined in said horizontal arm.

3. A unit curtain wall according to claim 2, said horizontal arm having an oblong hole extending longitudinally of said horizontal frame members, said positioning edges comprising a pair of opposed major edges of said oblong hole.

4. A unit curtain wall according to claim 1, including a thermally insulating connector disposed between said interior and exterior parts of a respective one of said horizontal frame members, and a covering bar disposed outside of said connector and extending longitudinally betweeen said interior and exterior parts of a respective one of said horizontal frame members, said covering bar of one of said vertically adjacent horizontal frame members supporting said sealing strip, said covering bar of the other horizontal frame member having said groove.

5. A unit curtain wall according to claim 4, said covering bar of said one horizontal frame member having a vertical fin carrying said sealing strip.

6. A unit curtain wall according to claim 4, said covering bar of said other horizontal frame member having a recess disposed exteriorly of said groove and extending longitudinally along the same, including a sealing member fitted in said recess and engageable with said covering bar of said one horizontal frame member.

7. A unit curtain wall according to claim 6, said sealing member being made of soft rubber.

8. A unit curtain wall according to claim 6, said sealing member having a pair of laterally spaced interior and exterior tongues, said interior tongue being engageable with an exterior side surface of said sealing strip, said exterior tongue being sealingly engageable with said covering bar of said one horizontal frame member.

9. A unit curtain wall according to claim 8, said interior tongue being tilted toward said exterior tongue.

* * * * *